US006953424B2

(12) United States Patent
Kusumoto et al.

(10) Patent No.: US 6,953,424 B2
(45) Date of Patent: Oct. 11, 2005

(54) ROTOR DRIVING APPARATUS WITH TEMPERATURE ADJUSTMENT OF ELASTIC SUPPORTING PORTION

(75) Inventors: Shoji Kusumoto, Hitachinaka (JP); Hiroyuki Takahashi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 236 days.

(21) Appl. No.: 10/629,548

(22) Filed: Jul. 30, 2003

(65) Prior Publication Data

US 2004/0023778 A1 Feb. 5, 2004

(30) Foreign Application Priority Data

Jul. 31, 2002 (JP) ..... P2002-222441

(51) Int. Cl.[7] ..... B04B 13/00; B04B 15/02

(52) U.S. Cl. ..... 494/10; 494/13; 494/14; 494/16; 494/82

(58) Field of Search ..... 494/1, 7, 10, 11, 494/13, 14, 16, 20, 31, 33, 82; 210/144, 179; 62/3.2, 3.6, 3.7

(56) References Cited

U.S. PATENT DOCUMENTS

| | | | | | |
|---|---|---|---|---|---|
| 3,600,900 | A | * | 8/1971 | Buddecke | 62/3.2 |
| 4,079,882 | A | * | 3/1978 | Mizuyoshi et al. | 494/60 |
| 4,099,667 | A | * | 7/1978 | Uchida | 494/7 |
| 4,512,758 | A | * | 4/1985 | Wedemeyer et al. | 494/13 |
| 4,785,637 | A | * | 11/1988 | Giebeler | 62/3.3 |
| 4,913,696 | A | * | 4/1990 | Romanauskas et al. | 494/10 |
| 5,067,938 | A | * | 11/1991 | Uchida et al. | 494/12 |
| 5,490,830 | A | * | 2/1996 | Lovelady et al. | 494/14 |
| 5,551,241 | A | * | 9/1996 | Boeckel et al. | 62/3.6 |
| 5,653,672 | A | * | 8/1997 | Niinai et al. | 494/14 |
| 2004/0023778 | A1 | * | 2/2004 | Kusumoto et al. | 494/10 |

FOREIGN PATENT DOCUMENTS

| | | | |
|---|---|---|---|
| EP | 0602639 A1 | * | 6/1994 |
| JP | 2-280853 | * | 11/1990 |
| JP | 5-212314 | * | 8/1993 |
| JP | 8-131896 | * | 5/1996 |
| JP | 9-141138 | * | 6/1997 |
| JP | 11-169748 A | | 6/1999 |
| JP | 11-333326 | * | 12/1999 |
| JP | 2000-5639 | * | 1/2000 |
| JP | 2000-237634 | * | 9/2000 |

* cited by examiner

*Primary Examiner*—Charles E. Cooley
(74) *Attorney, Agent, or Firm*—Sughrue Mion, PLLC

(57) ABSTRACT

In a centrifugal separator, a temperature sensor is provided in contact with a vibration isolation rubber that elastically supports an induction motor to a motor base. A Peltier element for heating/cooling the vibration isolation rubber is provided in contact with the vibration isolation rubber. The temperature sensor and the Peltier element is connected to a controller. Based on a detected temperature input from the temperature sensor, the controller controls heat generation or cooling effected by the Peltier element, thereby maintaining an optimum temperature of the vibration isolation rubber to maintain its damping characteristics.

12 Claims, 5 Drawing Sheets

ROTOR DRIVING APPARATUS WITH TEMPERATURE ADJUSTMENT OF ELASTIC SUPPORTING PORTION

BACKGROUND OF THE INVENTION

The present invention relates to a rotor driving apparatus, and more particularly to a supporting portion for a driving apparatus in which a rotor as a rotating body can easily become imbalanced to cause large vibrations, such as a centrifugal separator.

In conventional rotor driving apparatuses such as centrifugal separators, the rotational torque obtained with a driving device such as an electric motor is transmitted to a rotor through a rotation shaft to thereby rotate the rotor. The rotor can be mounted with a plurality of test tubes each enclosing a sample, and centrifugal separation of the sample within each test tube is effected by the rotation of the rotor.

Examples of the rotors used in centrifugal separators include: an angle rotor in which angles of insertion holes, which are arranged at equal intervals and into which samples are inserted, are constant; and a swing rotor in which a container (referred to as "bucket") to which the test tubes are mounted swings together with the rotation of the rotor. When performing a centrifugal operation, a user mounts test tubes to those rotors, each of the test tubes containing a sample for centrifugal separation. In this case, if the sample is contained in different amounts in the plural test tubes or if no test tube is inserted into a particular insertion hole, a center of gravity of the rotor and the test tubes as a whole is displaced from a center axis of the rotation, that is, eccentric gravity occurs so that the rotation of the rotor becomes imbalanced.

A rotational speed of a centrifugal separator is set in increments of 10 rpm in a range of, for example, from 300 to 1,000 rpm, and is set in increments of 100 rpm in a range of from 1,000 to the maximum rpm. In this case, a resonance point of a supporting system, which is determined based on a mass of the driving device and a spring constant of the supporting portion, may exist within its operating range. For instance, if an elastic shaft having a low rigidity is used as a rotation shaft, the elastic shaft has a large resonance point in a low-speed rotation region; once the resonance point is exceeded, a high-speed rotation can be attained in a stable manner.

When a rotor in an imbalanced state is rotated, the rotor generates vibrations, which are transmitted to the driving device or the casing. In particular, the vibrations become excessive near the above-mentioned resonance point, which often leads to breakage of the rotation shaft or the like. Thus, in order to suppress the vibrations of the driving device at the resonance point to a low level, a supporting portion having a vibration damping function is provided between the driving device and the casing. Generally, a supporting portion used for this purpose includes a spring element for blocking the transmission of vibrations to the casing, and a damper element such as a vibration isolation rubber for damping the vibrations. Therefore, in order to reduce the resonance magnification at the resonance point, the vibration isolation rubber selected should have a high energy-absorption factor (high loss factor).

However, the actual temperature of the vibration isolation rubber is not only dependent on room temperature (2 to 40° C.) at which it is used, but is also largely changed due to heat generated from an induction motor during driving. In that case, the damping characteristics of the rubber are changed to eliminate an initial high loss factor, which ultimately results in the generation of vibrations or noises in the apparatus.

For instance, assuming that a rotor is in the same unbalanced state, measurement of the rotor vibration amplitude is conducted with respect to the following two cases: a case where the temperature of the rubber is at the highest within the room temperature range in which the centrifugal separator can be used (when the loss factor and dynamic modulus of elasticity are at the minimum); and a case where the temperature of the rubber is at the lowest (when the loss factor and dynamic modulus of elasticity are at the maximum). The measured values are shown in FIG. 8. As indicated by a solid line A in a graph of FIG. 8, when the temperature of the vibration isolation rubber is at the highest, the amplitude at a first resonance point can be suppressed to a lower level in a low-speed rotation region. However, a sharp vibration peak appears in a range of 3,500 to 6,000 rpm, with the amplitude reaching its maximum level at the resonance point of a supporting system near 4,000 rpm. On the other hand, as indicated by a broken line B in FIG. 8, when the temperature of the vibration isolation rubber is at the lowest, a sharp vibration peak, such as one observed in the case where the temperature of the vibration isolation rubber is at the highest, does not appear in the range of 3,500 to 6,000 rpm. However, the amplitude at the first resonance point becomes extremely large in the initial low-speed rotation region. Note that the peak in the low rpm region refers to the first resonance point observed in the case where an elastic shaft having a low elasticity is used as the rotation shaft. In this case, the peak is inevitably exists within the operating range of the apparatus.

SUMMARY OF THE INVENTION

It is an object of the present invention to provide a rotor driving apparatus and a centrifugal separator, in which large changes in vibration can be prevented from occurring due to temperature characteristics of a vibration isolation rubber and a desired damping effect can be exhibited to achieve stable driving.

This and other objects of the present invention will be attained by a rotor driving apparatus including a casing, a rotor, a driving unit, a supporting portion, a temperature sensor, a temperature adjusting device and a controller. The rotor is rotatably disposed within the casing. The driving unit is supported to the casing for rotationally driving the rotor. The supporting portion elastically supports the driving unit to the casing, the supporting portion includes a vibration isolation rubber. The temperature sensor detects a temperature of the supporting portion or an ambient area thereof and outputs temperature data. The temperature adjusting device performs one of cooling and heating of the supporting portion. The controller controls a temperature generated by the temperature adjusting device based on the temperature data from the temperature sensor for controlling the temperature of the supporting portion to a predetermined temperature.

DETAILED DESCRIPTION OF THE PREFERRED EMBODIMENTS

Figure 1:
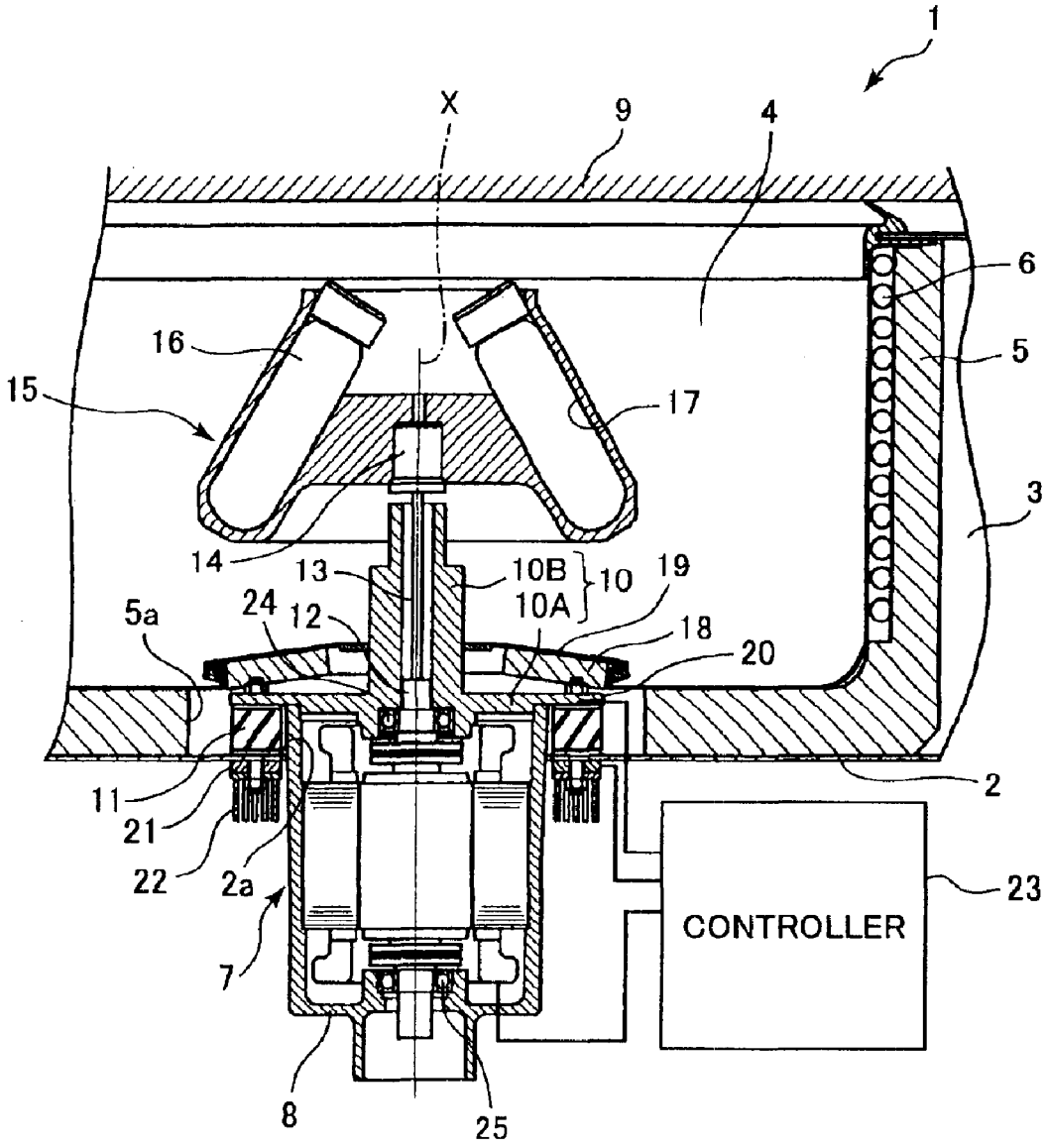
FIG. 1 is a partial cross-sectional view of a centrifugal separator according to a first embodiment of the present invention.

A centrifugal separator 1 according to a first embodiment of the present invention will be described based on FIG. 1. A horizontally extending partition plate (motor base) 2 is supported to a main body (not shown), and an upper chamber 3 is defined by the main body and the partition plate 2. A central opening 2*a* is formed in the partition plate 2. Disposed on top of the partition plate 2 is a closed-end tubular insulating member 5 for defining a centrifuge chamber 4, and disposed on the inner peripheral surface of the insulating member 5 is a refrigerant pipe 6 for cooling the interior of the centrifuge chamber 4. Formed at the bottom portion of the insulating member 5 is an opening 5*a* that is concentric with the opening 2*a* of the partition plate 2. A motor housing 8 of an induction motor 7 serving as a driving device is inserted and disposed in the space defined inside those openings 2*a* and 5*a*.

A cover 9 is provided over the upper end opening of the upper chamber 3 such that it can be opened and closed. An upper portion of the motor housing 8 is covered with an end bracket 10, and the end bracket 10 is supported to the partition plate 2 through a vibration isolation rubber 11 that serves as a supporting member. Thus, the motor housing 8 is supported in suspension and vibrations of the induction motor 7 are damped by the vibration isolation rubber 11.

A rotation shaft (elastic shaft) 13 extending into the centrifugal chamber 4 is connected coaxially to a rotator (output shaft) 12 of the induction motor 7. A crown portion 14 is provided at the upper end of the rotation shaft 13, and an angle rotor 15 is detachably mounted on the crown portion 14. The angle rotor 15 is generally circular in shape and has insertion holes 17 oriented at predetermined angles relative to the rotation axis center X. A plurality of test tubes 16 each enclosing a sample are inserted in the angled insersion holes 17.

The end bracket 10 has a flange portion 10A constituting a part of the motor housing 8, and a hollow bearing-supporting portion 10B that projects from the flange portion 10A and receives the output shaft 12 and the rotation shaft 13. The flange portion 10A is supported to the partition plate 2 through the vibration isolation rubber 11 described above. The output shaft 12 is rotatably supported to the motor housing 8 by means of a bearing 24 disposed in the bearing supporting portion 10B and a bearing 25 disposed in the bottom portion of the motor housing 8. The thrust load of the output shaft 12 is taken up on those bearings 24 and 25. The bottom opening 5*a* of the insulating member 5 is closed by a cover 18 located around the bearing supporting portion 10B and the top surface of the cover 18 is covered with a rubber body 19, thereby preventing air from being sucked into the centrifuge chamber 4 through the opening 5*a* as the rotor 15 rotates.

A temperature sensor 20 for measuring a temperature of the vibration isolation rubber 11 is interposed between the vibration isolation rubber 11 and the flange portion 10A. A Peltier element 21 serving as a temperature adjusting device is provided at a position immediately below the vibration isolation rubber 11 and on the downside of the partition plate 2 for heating or cooling the vibration isolation rubber 11. A plurality of radiating fins 22 suspend downward from the Peltier element 21. The temperature adjusting device 21 is required to provide a desired damping effect of the vibration isolation rubber 11 by controlling a temperature of the rubber 11 irrespective of heat generated as the induction motor 7 is rotationally driven, otherwise the vibration isolation rubber 11 is over-heated to undergo a change in its damping characteristics. In this case, the Peltier element 21 is an element which gives rise to a phenomenon whereby either heat generation or hear absorption takes plate at the contact of two conductors or semiconductors of different kinds when a current flows through the contact. This heat generation/absorption is reversed if the current flow direction is reversed. Further, the temperature sensor 20 and the Peltier element 21 are connected to a controller 23. The controller 23 serves to control the rotational speed of the motor 7, and also serves to control heating or cooling of the vibration isolation rubber 11 by the Peltier element 21 upon controlling the flow direction and the application time period of an electrical current with respect to the Peltier element 21 based on a detected temperature data input from the temperature sensor 20 so that the temperature of the vibration isolation rubber 11 is within a predetermined temperature range. To this effect, the controller 23 is provided with a RAM (not shown) and a CPU (not shown) The RAM serves as a setting and storage portion for setting and storing a temperature range that allows the vibration isolation rubber 11 to exhibit its desired damping characteristics. The CPU makes a comparison between the set temperature range thus stored and a detected temperature input from the temperature sensor 20 to change or maintain the direction and the application time period of electrical current with respect to the Peltier element based on the results of the comparison.

Figure 6:
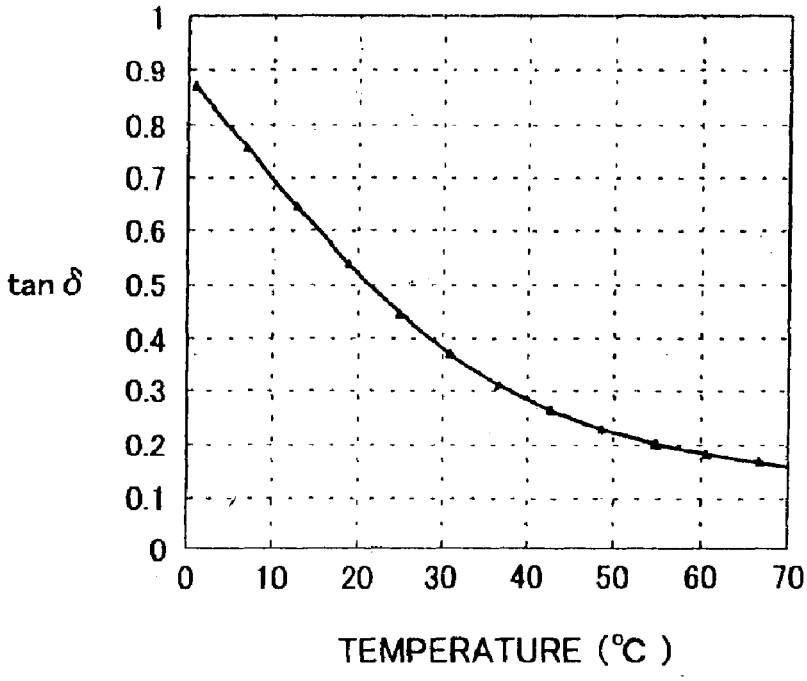
FIG. 6 is a graph showing a relationship between the temperature and the loss factor of a vibration isolation rubber.
Figure 7:
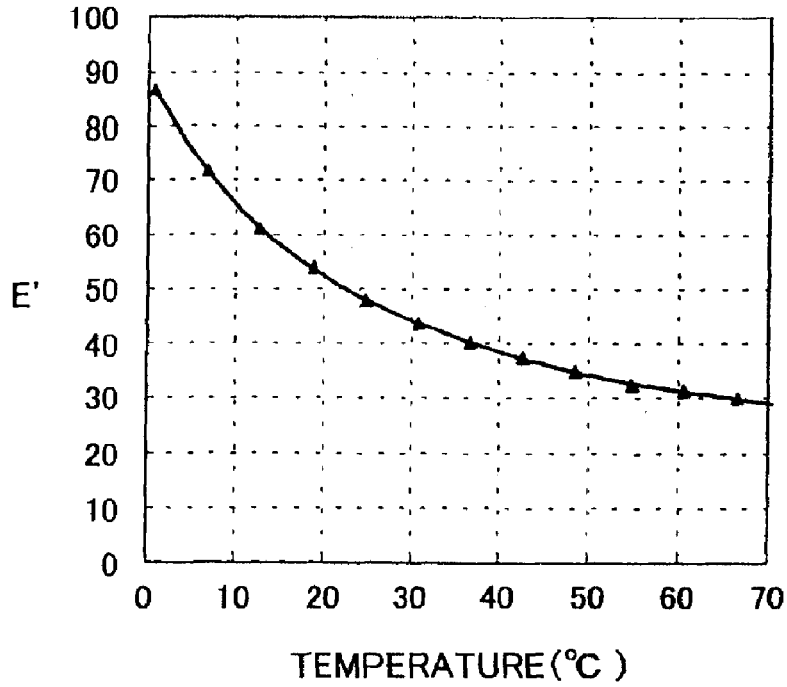
FIG. 7 is a graph showing a relationship between the temperature and the dynamic modulus of elasticity of the vibration isolation rubber.
Figure 8:
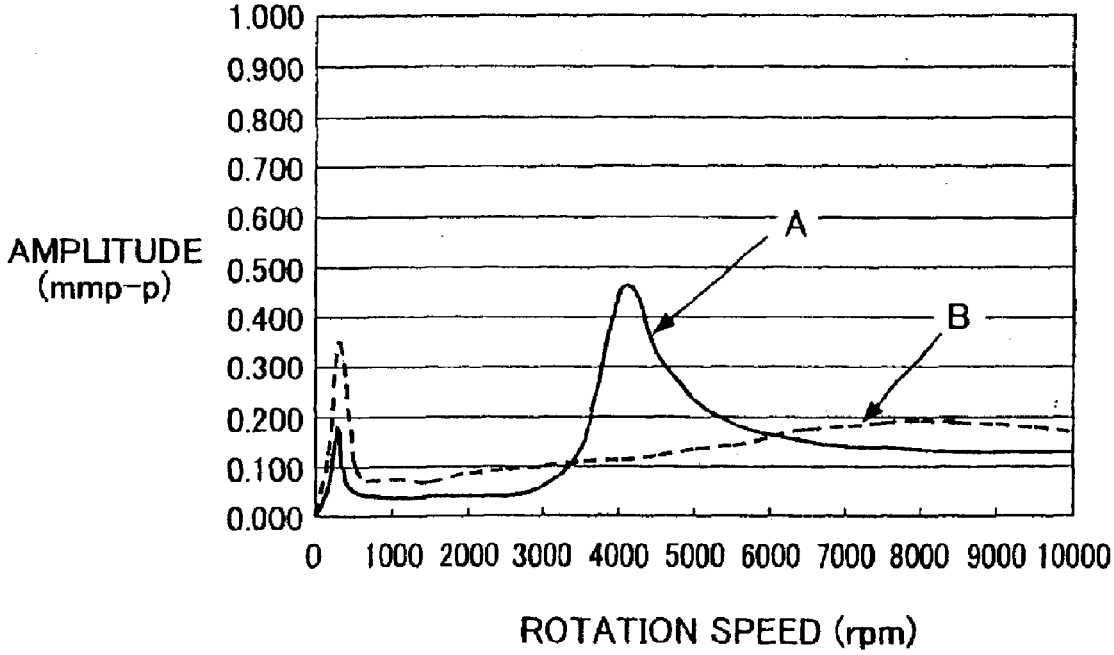
FIG. 8 is a graph showing a difference in vibration due to a difference in the temperature of the vibration isolation rubber.

Next, temperature characteristics of the vibration isolation rubber 11 will be described. In the case where a rubber-type damper FE 5150 manufactured by Fuji Polymatech Co., Ltd. is used as the vibration isolation rubber 11, as shown in FIG. 6, the loss factor (tanδ), which represents damping characteristics of rubber, decreases linearly in the rubber temperature range of from 0° C. to about 40° C. Thereafter, the loss factor is gradually decreased. Likewise, as shown in FIG. 7, the dynamic modulus of elasticity (E'), which represents a spring constant of rubber, decreases as the temperature becomes higher. Thus, it can be seen that, when using the rubber-type damper FE 5150 of Fuji Polymatech Co., Ltd. as the vibration isolation rubber, its temperature should be maintained within a range of 15° C. to 25° C. in view of the results shown in FIGS. 6 and 7.

With the above-described arrangement, the rotor 15, which is mounted with the plurality of test tubes 16 each enclosing a sample, is attached onto the crown 14 situated at the top end of the rotation shaft 13 extending from the induction motor 7, and the rotor 15 is rotated by means of rotational driving of the induction motor 7. At this time, if the rotor 15 is rotated while the test tubes 16 are being mounted to the rotor 15 in the state where the quantity of the sample differs among the plurality of test tubes 16, or if it is rotated in the state where the test tubes are not mounted to all of the test-tube insertion holes 17, the rotor 15 is brought into an imbalanced state so that a bending moment is generated in the rotation shaft 13. While a sinusoidal vibromotive force corresponding to the rotational frequency is thus added to the induction motor 7 to generate vibrations, the damping effect of the vibration isolation rubber 11 serves to prevent the vibrations from being transmitted to the main body, and vibrations of the induction motor 7 itself are damped at the same time.

As the induction motor 7 is driven, the induction motor 7 generates heat, which is transmitted to the vibration isolation rubber 11 so that the temperature of the vibration isolation rubber 1 also increases. If a temperature detected by the temperature sensor 20 becomes higher than a set temperature stored in the controller 23, the controller 23 causes a forward current to be applied to the Peltier element 21 so that the Peltier element 21 performs cooling of the vibration isolation rubber 11, with the radiating fins 22 promoting the cooling operation. On the other hand, in the case where a temperature detected by the temperature sensor 20 is lower than a set temperature stored in the controller 23, the controller 23 causes a reverse current to be applied to the Peltier element 21 so that the vibration isolation rubber is heated by the Peltier element 21. Therefore, the damping characteristics of the vibration isolation rubber 11 can be maintained within a desired range.

As described above, in the rotor driving apparatus of this embodiment, variations in vibration attributable to temperature characteristics of the rubber can be restrained. Therefore, reduced vibrations can result by controlling temperature of the vibration isolation rubber 11 to its optimum temperature at which the vibration isolation rubber 11 can exhibit optimum characteristic. Further, a reduction in vibration also affords an enhanced tolerance against driving of the rotor in an unbalanced state which occurs due to erroneous handling by a user, thus also making it possible to achieve a reduction in noise. Moreover, not only cooling but also heating of the vibration isolation rubber 11 can be performed by the Peltier element 21 so that the temperature of the vibration isolation rubber 11 can be maintained at an optimum level.

A centrifugal separator 101 according to a second embodiment of the present invention will be described based on FIG. 2. Note that, in FIG. 2, the parts that are the same or similar to those of FIG. 3 are denoted by the same symbols and description thereof will be omitted. In the second embodiment, a cooling fan 26 is attached to the main body of the centrifuge for cooling the major region of the motor housing 8 of the induction motor 7, and the vibration isolation rubber 11 is located at a position where it is exposed to a coolant flow indicated by an arrow A. Specifically, a stepped portion 102A is formed in the partition plate 102 at a position adjacent to the vibration isolation rubber 11, thus making it easier for the coolant flow A to strike the vibration isolation rubber 11. A coil-like heater 121 is disposed around the vibration isolation rubber 11 instead of the Peltier element 21 used in the first embodiment, and the heater 121 is connected to a controller 123.

While the vibration isolation rubber 11 is cooled by the coolant flow A, if it is judged that excessive cooling has occurred based on an input of temperature data from the temperature sensor 20, a heating signal is output to the heater 121 from the controller 123 to heat the vibration isolation rubber 11. Once the temperature of the vibration isolation rubber 11 is elevated to a predetermined temperature, the temperature is detected and the heating by the heater 121 is stopped.

As described above, according to the second embodiment, while the vibration isolation rubber 11 is exclusively cooled by the cooling fan 26, only in the event that it is cooled below a predetermined temperature, the heater 121 is actuated to heat the vibration isolation rubber to a predetermined temperature and keep the vibration isolation rubber 11 at optimum temperature, thereby making it possible to maintain optimum characteristics of the vibration isolation rubber.

Figure 3:
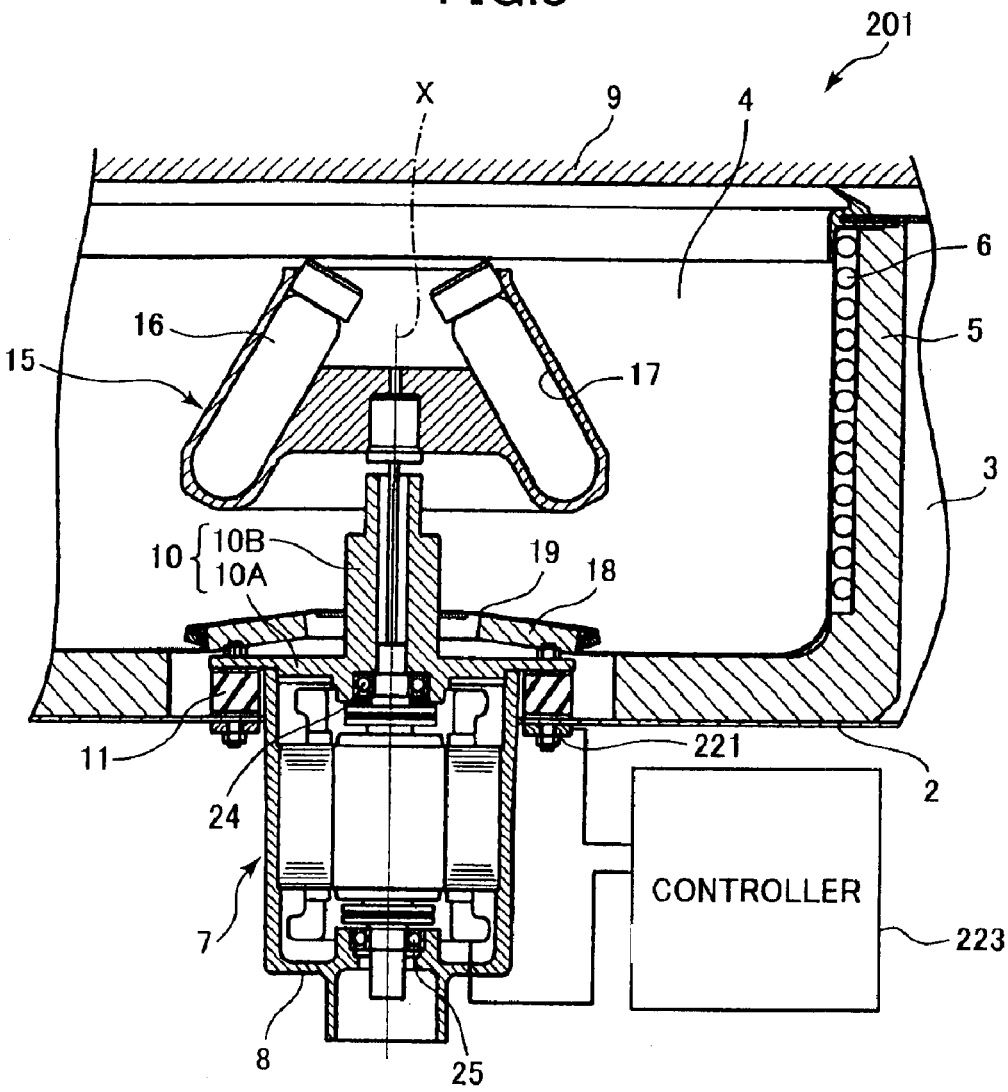
FIG. 3 is a partial cross-sectional view of a centrifugal separator according to a third embodiment of the present invention.
Figure 4:
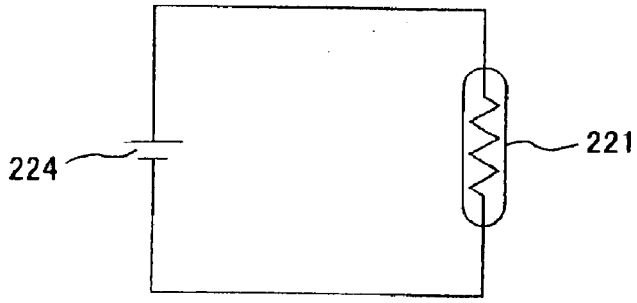
FIG. 4 is a diagram of a constant-voltage circuit for a thermistor according to the third embodiment.
Figure 5:
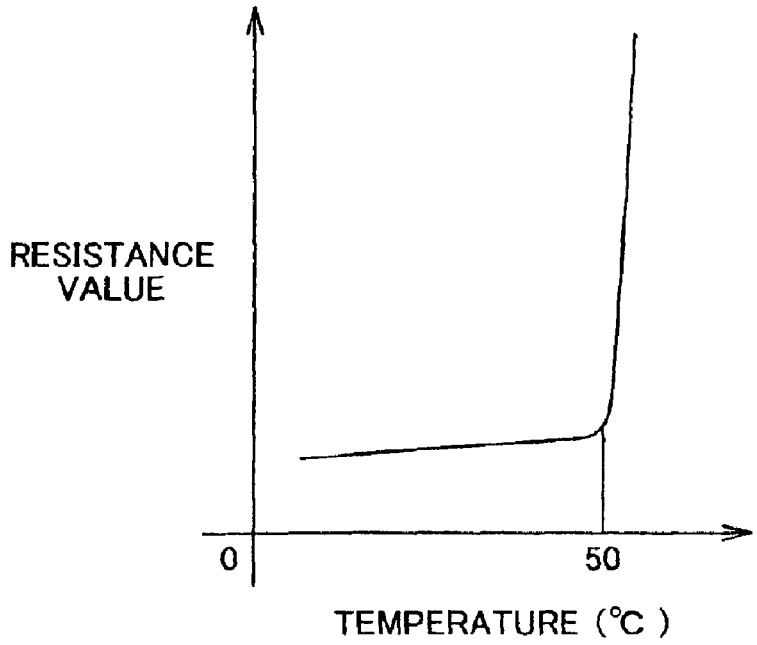
FIG. 5 is a graph showing a relationship between the temperature and the resistance value of the thermistor.

A centrifugal separator 201 according to a third embodiment of the present invention will be described based on FIGS. 3 through 5. Note that, in FIG. 3, the parts that are the same or similar to those of FIG. 1 are denoted by the same symbols and description thereof will be omitted. In accordance with the third embodiment, a thermistor 221 is provided for exhibiting functions of the temperature sensor and the temperature adjusting device of the first and second embodiments. That is, as shown in FIG. 5, the thermistor 221 has such temperature characteristics that its resistance value sharply increases once its temperature reaches a predetermined value, for example 50° C. As shown in FIG. 3, the thermistor 221 is disposed in the vicinity of the bottom portion of the vibration isolation rubber 11, the thermistor 221 being applied with a constant voltage by a constant-voltage power supply 224 as shown in FIG. 4. Such a constant-voltage circuit is incorporated into a control device 223 that controls the rotation of the motor 7. When a constant voltage is applied to the thermistor 221 simultaneously with the driving of the motor 7, the temperature of the thermistor 221 is elevated to 50° C. due to self-heating in accordance with its characteristics shown in FIG. 5. However, at a temperature of 50° C. or higher, its resistance value increases to cause a reduction in electric current, so that an amount of heat generation decreases to restrain a further increase in temperature. Therefore, when the centrifuge is driven in the state where the ambient temperature is 50° C. or below, the temperature of the thermistor 221 is maintained at roughly 50° C. so that the temperature of the vibration isolation rubber 11 can be maintained constant at that temperature. In accordance with the third embodiment, the temperature characteristics of the thermistor itself provide a function equivalent to that of the temperature sensor of the first and second embodiments, so that the heat-generating thermistor functions as the temperature adjusting device.

The rotor driving apparatus according to the present invention is not limited to the embodiments described above, but various modifications may be made within the scope of the invention as described in the appended claims. For instance, while in the above-described first and second embodiments the temperature sensor 20 is provided in intimate contact between the vibration isolation rubber 11 and the flange portion 10A, the position of the temperature sensor is not limited as far as the temperature sensor can detect the room temperature near the vibration isolation rubber to thereby estimate the temperature of the vibration isolation rubber.

Further, in the first embodiment, the vibration isolation rubber 11 is in contact with the driving unit 7. Based on this configuration, the first embodiment can be modified such that, by endowing the Peltier element 21 with only the function of cooling the vibration isolation rubber 11 and substituting the heating function exclusively by transmission of the heat generated by the induction motor to the vibration isolation rubber 11, the Peltier element 11 may be driven and controlled at the time when the temperature of the vibration isolation rubber 11 exceeds a predetermined value.

Figure 2:
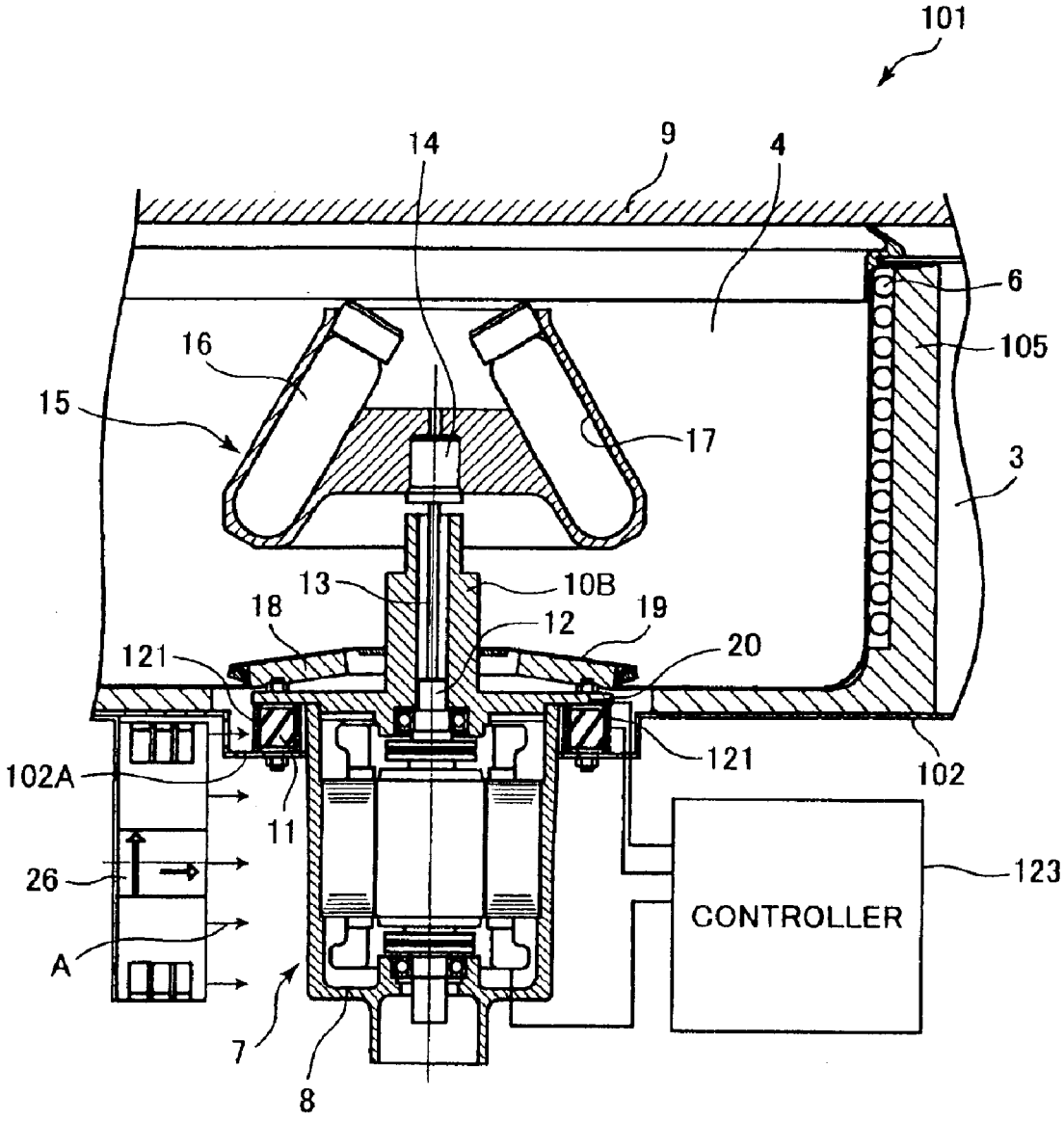
FIG. 2 is a partial cross-sectional view of a centrifugal separator according to a second embodiment of the present invention.

Further, the second embodiment shown in FIG. 2 can be modified such that the temperature sensor 20 and the heater 121 are dispensed with, and a thermistor can be provided at the same position as the thermistor 221 of the third embodiment instead of the heater 121. Furthermore, a thermistor can be attached on the outer periphery of the vibration isolation rubber 11 in the same manner as the heater 121 of the second embodiment. The use of a thermistor eliminates the temperature sensor 20 in the second embodiment In addition, while the controller 23, 123 executes not only the temperature control of the vibration isolation rubber 11 but also the rotation control of the induction motor 7, it is also possible to prepare separate controllers for the separate controls individually.

What is claimed is:

1. A rotor driving apparatus comprising:

a casing;

a rotor rotatably disposed within the casing;

a driving unit supported to the casing for rotationally driving the rotor;

a supporting portion that elastically supports the driving unit to the casing, the supporting portion having a vibration isolation rubber;

a temperature sensor that detects a temperature of the supporting portion or an ambient area thereof and outputs temperature data;

a temperature adjusting device that performs one of cooling and heating of the supporting portion; and a controller that controls a temperature generated by the temperature adjusting device based on the temperature data from the temperature sensor.

2. The rotor driving apparatus as claimed in claim 1, wherein the temperature adjusting device comprises a Peltier element.

3. The rotor driving apparatus as claimed in claim 1, wherein the temperature adjusting device comprises a cooling device.

4. The rotor driving apparatus as claimed in claim 1, further comprising cooling means for cooling the driving unit, and wherein the temperature adjusting device comprises a heating device.

5. The rotor driving apparatus as claimed in claim 1, wherein the temperature adjusting device comprises a thermistor.

6. A rotor driving apparatus comprising:

a casing;

a rotor rotatably disposed within the casing;

a driving unit supported to the casing for rotationally driving the rotor;

a supporting portion that elastically supports the driving unit to the casing, the supporting portion having a vibration isolation rubber;

a thermistor that heats the supporting portion or an ambient area thereof to a predetermined temperature; and, a constant-voltage circuit for applying a constant voltage to the thermistor.

7. A centrifuge comprising:

a casing;

a rotor rotatably disposed within the casing, test tubes each containing a testing sample therein being held in the rotor for centrifugal separation;

a driving unit supported to the casing for rotationally driving the rotor;

a supporting portion that elastically supports the driving unit to the casing, the supporting portion having a vibration isolation rubber;

a temperature sensor that detects a temperature of the supporting portion or an ambient area thereof and outputs temperature data;

a temperature adjusting device that performs one of cooling and heating of the supporting portion; and a controller that controls a temperature generated by the temperature adjusting device based on the temperature data from the temperature sensor.

8. The centrifuge as claimed in claim 7, wherein the temperature adjusting device comprises a Peltier element.

9. The centrifuge as claimed in claim 7, wherein the temperature adjusting device comprises a cooling device.

10. The centrifuge as claimed in claim 7, further comprising cooling means for cooling the driving unit, and wherein the temperature adjusting device comprises a heating device.

11. The centrifuge as claimed in claim 7, wherein the temperature adjusting device comprises a thermistor.

12. A centrifuge comprising:

a casing;

a rotor rotatably disposed within the casing, test tubes each containing a testing sample therein being held in the rotor for centrifugal separation;

a driving unit supported to the casing for rotationally driving the rotor;

a supporting portion that elastically supports the driving unit to the casing, the supporting portion having a vibration isolation rubber;

a thermistor that heats the supporting portion or an ambient area thereof to a predetermined temperature; and, a constant-voltage circuit for applying a constant voltage to the thermistor.

* * * * *